US006685463B2

(12) United States Patent
Finke et al.

(10) Patent No.: US 6,685,463 B2
(45) Date of Patent: Feb. 3, 2004

(54) AIR AND FUEL STAGED BURNER

(75) Inventors: Harry P. Finke, Pittsburgh, PA (US); Gregory T. Kitko, Evansville, IN (US); Andrew J. Johnson, Eighty-Four, PA (US); John R. Hemmerlin, Evans City, PA (US)

(73) Assignee: Bloom Engineering Co., Inc., Pittsburgh, PA (US)

( * ) Notice: Subject to any disclaimer, the term of this patent is extended or adjusted under 35 U.S.C. 154(b) by 0 days.

(21) Appl. No.: 09/738,142

(22) Filed: Dec. 15, 2000

(65) Prior Publication Data

US 2001/0038985 A1 Nov. 8, 2001

Related U.S. Application Data

(60) Provisional application No. 60/171,073, filed on Dec. 16, 1999.

(51) Int. Cl.[7] ..... F23M 3/04

(52) U.S. Cl. ..... 431/10; 431/351; 431/115

(58) Field of Search ..... 431/10, 8, 9, 181, 431/185, 187, 188, 190, 350, 351, 354, 115, 116; 239/398, 399, 403, 427

(56) References Cited

U.S. PATENT DOCUMENTS

| | | | | | |
|---|---|---|---|---|---|
| 3,022,815 | A | * | 2/1962 | Bloom et al. | 431/185 |
| 4,023,921 | A | * | 5/1977 | Anson | 431/115 |
| 4,095,929 | A | * | 6/1978 | McCartney | 431/188 |
| 4,351,632 | A | * | 9/1982 | Nagai | 431/190 |
| 4,629,413 | A | * | 12/1986 | Michelson et al. | 431/10 |
| 4,645,449 | A | | 2/1987 | Schwartz et al. | 431/8 |
| 4,732,093 | A | | 3/1988 | Hansen et al. | 110/347 |
| 4,859,173 | A | * | 8/1989 | Davis, Jr. et al. | 431/9 |
| 4,878,829 | A | * | 11/1989 | Anderson | 431/187 |
| 4,983,118 | A | | 1/1991 | Hovis et al. | 431/115 |
| 4,988,285 | A | | 1/1991 | Delano | 431/5 |
| 5,092,761 | A | * | 3/1992 | Dinicolantonio | 431/115 |
| 5,180,300 | A | | 1/1993 | Hovis et al. | 431/115 |
| 5,209,656 | A | | 5/1993 | Kobayashi et al. | 431/187 |
| 5,295,816 | A | | 3/1994 | Kobayashi et al. | 431/9 |
| 5,431,559 | A | | 7/1995 | Taylor | 431/164 |
| 5,449,286 | A | | 9/1995 | Snyder et al. | 431/9 |
| 5,460,512 | A | * | 10/1995 | Lifshits et al. | 431/9 |
| 5,944,507 | A | * | 8/1999 | Feldermann | 431/351 |
| 6,068,470 | A | * | 5/2000 | Zarzalis et al. | 431/187 |

FOREIGN PATENT DOCUMENTS

| | | | |
|---|---|---|---|
| EP | 0 076 036 A | * | 4/1983 |
| EP | 0430376 | | 6/1991 |
| JP | 60-78208 A | * | 5/1985 |

* cited by examiner

*Primary Examiner*—Josiah Cocks
(74) *Attorney, Agent, or Firm*—Webb Ziesenheim Logsdon Orkin & Hanson, P.C.

(57) ABSTRACT

A burner (10) for reducing $NO_x$ emissions where supply fuel (16) and supply air (20) are supplied to a combustion tunnel (52) at high and low velocities and secondary air (26) is supplied to a secondary combustion zone (60), wherein products of combustion (59) exiting into the secondary combustion zone (60) from the combustion tunnel (52) are drawn back into the combustion tunnel (52) and back into the secondary air conduit (54).

9 Claims, 2 Drawing Sheets

AIR AND FUEL STAGED BURNER

CROSS-REFERENCE TO RELATED APPLICATION

This application claims the benefit of earlier filed United States Provisional Patent Application Ser. No. 60/171,073, filed Dec. 16, 1999, entitled "Air and Fuel Staged Burner".

BACKGROUND OF THE INVENTION

1. Field of the Invention

The present invention relates to burners and, more particularly, to low $NO_x$ emission burners having staged air and staged fuel capabilities.

2. Brief Description of the Prior Art

Low $NO_x$ burners are known in the art. For example, U.S. Pat. Nos. 5,180,300 and 4,983,118 both disclose low $NO_x$ regenerative burners. Likewise, U.S. Pat. No. 4,732,093 to Hansen et al. discloses a method and apparatus for burning fuel in an annular nozzle burner. However, there exists a need for a burner that further reduces $NO_x$ generation.

SUMMARY OF THE INVENTION

The present invention provides an air and fuel staged burner that reduces $NO_x$ generation. One embodiment of a burner according the present invention generally includes a main burner body defining an internal cavity, an air connection fluidly connected to the internal cavity, and a combustion tunnel. A distribution tee may be fluidly connected to the internal cavity defined by the main burner body and a burner nozzle may be positioned in the interior cavity of the main burner body. The burner nozzle may define a primary air orifice, an annulus, and a fuel orifice. The air connection may be configured to receive supply air and divide the supply air into primary air and secondary air, where the ratio of primary air to secondary air is approximately in the range of 40/60 to 70/30 respectively, with a 50/50 ratio being preferred. The primary air preferably flows through the primary air orifice at a rate of approximately 300–400 feet/second (91–122 meters/second).

The main burner body generally extends longitudinally about an imaginary burner centerline, and the primary air orifice is preferably oriented to form a convergent angle as measured from the imaginary burner centerline, such as an angle of approximately 30–60° as measured from the imaginary burner centerline. Alternatively, the primary air orifice may be oriented to produce a swirl pattern of primary air in the combustion tunnel, where the swirl is approximately less than or equal to 0.7 times an internal diameter of the combustion tunnel.

The burner may also include a secondary air conduit fluidly connected to the distribution tee, the secondary air conduit having a secondary air jet fluidly connected to a secondary combustion zone. The main burner body generally extends longitudinally about an imaginary burner centerline and the secondary air jet is oriented substantially parallel to the imaginary burner centerline. Alternatively, the main burner body may extend longitudinally about the imaginary burner centerline with the secondary air jet oriented at an angle convergent with the imaginary burner centerline. The secondary air exits the secondary air jet at a velocity of approximately 150–400 feet/second (46–122 meters/second).

A fuel connector is configured to receive a supply fuel and divide the supply fuel into a primary fuel and a secondary fuel. The split ratio of primary fuel to secondary fuel split ratio is approximately in the range of 20/80 to 40/60 respectively, with a split ratio of 22/78 being preferred. A primary fuel path and a secondary fuel path may also be included, with the primary fuel path fluidly connected to the annulus, the secondary fuel path fluidly connected to the fuel orifice, and the primary fuel path and the secondary fuel path fluidly connected to each other. The primary fuel may exit the annulus defined by the burner nozzle at a velocity approximately less than 100 feet/second (30 meters/second). The secondary fuel may exit the fuel orifice defined by the burner nozzle at a velocity approximately greater than 350 feet/second. The fuel orifice and the fuel annulus may lie in the same plane, substantially perpendicular to an imaginary burner centerline and the distribution tee may be positioned adjacent to the internal cavity of the main burner body and opposite the combustion tunnel (52).

One method of decreasing $NO_x$ emissions in a burner having a main burner body defining a combustion tunnel may include the steps of flowing supply air into the main burner body, dividing the supply air into primary air and secondary air, flowing the primary air into the combustion tunnel at a given velocity, flowing primary fuel into the combustion tunnel at a velocity lower than the velocity of the primary air, flowing secondary fuel into the combustion tunnel at a velocity higher than the velocity of the primary fuel, flowing secondary air into a secondary combustion zone by a secondary air jet at a velocity higher than the velocity of the primary fuel, and igniting the primary fuel, the secondary fuel, and primary air in the combustion tunnel to form products of combustion. Additional steps may include exhausting products of combustion into the secondary combustion zone and drawing products of combustion into the combustion tunnel and into the secondary air jet.

The device and method according to the present invention helps to reduce burner $NO_x$ emissions.

These and other features and advantages of the present invention will be clarified in the description of the preferred embodiment taken together with the attached drawings in which like reference numerals represent like elements throughout.

DETAILED DESCRIPTION OF THE PREFERRED EMBODIMENT

Figure 1:
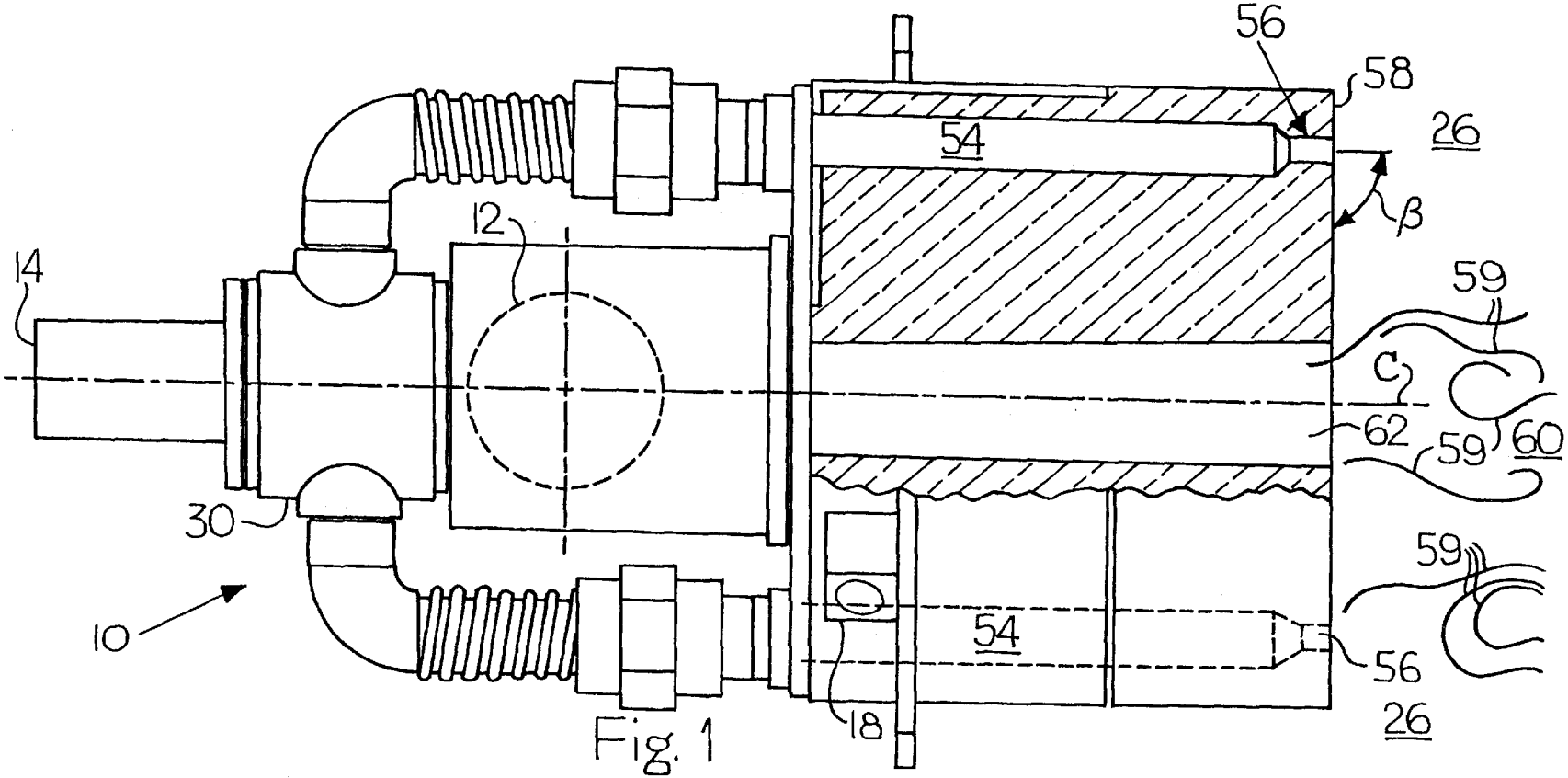
FIG. 1 is a partial cross-sectional side view of one embodiment of the present invention.
Figure 3:
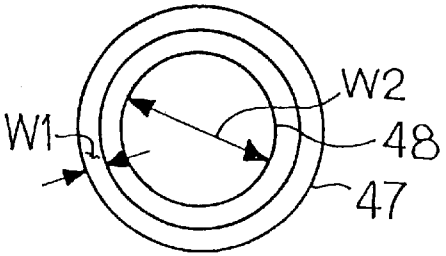
FIG. 3 is a front view of a burner nozzle shown in FIG. 2.
Figure 2:
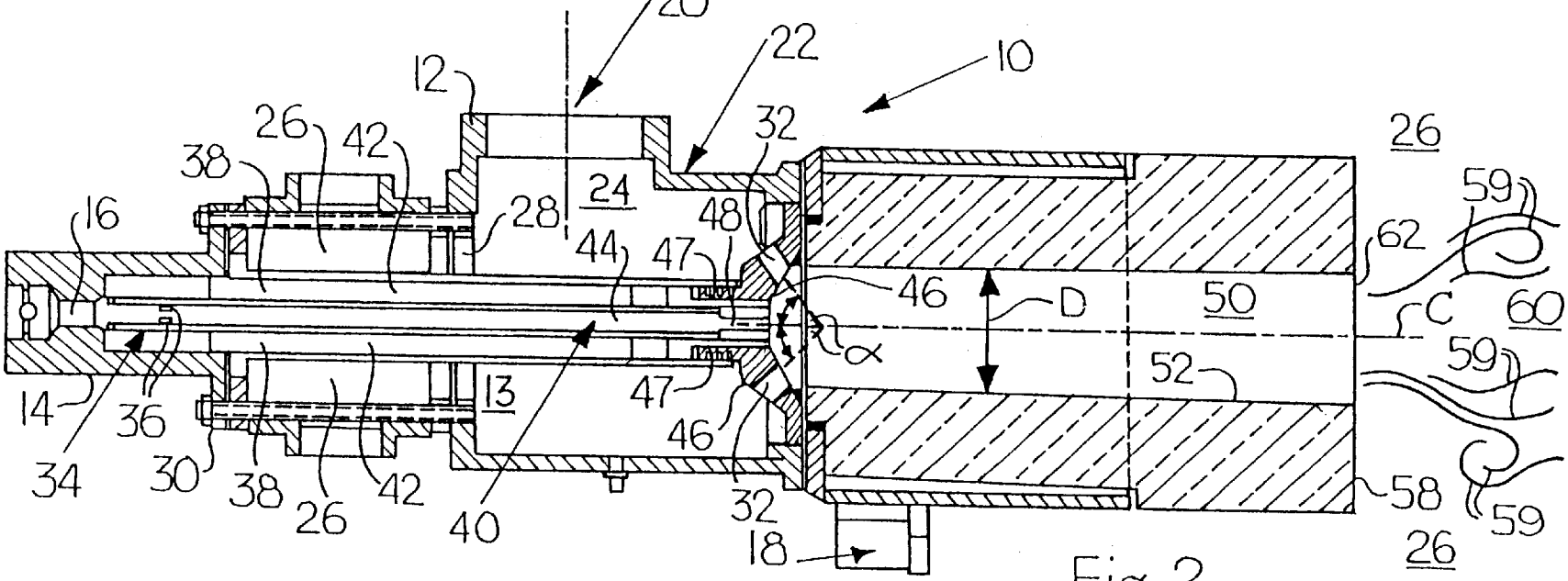
FIG. 2 is a full cross-sectional side view of the embodiment shown in FIG. 1 excluding the secondary air jets for clarity and rotating the location of the primary air connection by 90 degrees.

The preferred embodiment of a burner 10 according to the present invention is shown in FIGS. 1–3. FIG. 2 shows the burner 10 having a main burner body 22 defining an air connection 12, an internal cavity 13, and a combustion tunnel 52. A fuel connector 14 is provided through which supply fuel 16 enters the burner 10, except in the event a gas pilot (not shown) is used through a port 18. An electrode (not shown) is used to ignite the burner 10; however, a gaseous pilot could be used.

As best shown in FIG. 2, supply air 20 enters the air connection 12, passes into the internal cavity 13 defined by the main burner body 22, and is divided into primary air 24 and secondary air 26. A secondary air orifice 28 permits the secondary air 26 to enter a secondary air distribution tee 30 while the primary air 24 passes through at least one primary air orifice 32 defined by a burner nozzle 46, with the number of primary air orifices 32 preferably in the range of four to eight orifices 32. The primary air 24 is accelerated through the primary air orifice or orifices 32 to a range of approximately 300 feet/second–400 feet/second (91–122 meters/second), depending on the air preheat available, nominal burner 10 ratio, and rated input. The primary air 24 is preferably directed in a convergent manner toward an imaginary burner centerline C; however, the primary air orifice or orifices 32 may also be slightly offset to induce a swirl pattern on the primary air 24. A convergence angle $\alpha$ of the primary air orifice or orifices 32 can be approximately 30°–60°, as measured from the imaginary burner centerline C. The swirl or offset can be as much as 0.7 times the primary port, or combustion tunnel, diameter D.

The supply fuel 16 entering fuel connector 14 passes into a fuel sparger 34 which divides the supply fuel 16 via holes 36 into primary fuel 38 and secondary fuel 40. The primary fuel 38 travels along one or more primary fuel paths 42, preferably parallel to the secondary fuel 40 which travels through a secondary fuel path 44. The primary fuel path 42 is preferably fluidly connected to an annulus 47 defined by the burner nozzle 46 positioned in the internal cavity 13 defined by the main burner body 22. The secondary fuel path 44 is preferably fluidly connected to a fuel orifice 48, also defined by the burner nozzle 46. The primary fuel 38 exits the burner nozzle 46 through the annulus 47 into the combustion tunnel 52 at a low velocity, ideally less then 100 feet/second (30 meters/second), depending on rated input. The secondary fuel 40 passes down the secondary fuel path 44 and exits into the combustion tunnel 52 through fuel orifice 48, preferably accelerated to a velocity approximately greater than 350 feet/second (107 meters/second), depending on rated input. As shown in FIG. 3, the fuel annulus 47 preferably has a first width W1 and the fuel orifice 48 preferably has a second width W2, with the first width W1 of the fuel annulus 47 being less than the second width W2 of the fuel orifice 48.

Referring again to FIG. 2, the velocities of the primary and the secondary fuels 38, 40 exiting the annulus 47 and the fuel orifice 48 of the burner nozzle 46 will depend on the velocity of the primary air 24 exiting the primary air orifice or orifices 32. The primary fuel 38 exiting the annulus 47 mixes in a highly turbulent region with the primary air 24 exiting the primary air orifice or orifices 32, creating a highly reducing combustion region within the combustion tunnel 52. The secondary fuel 40 exiting the fuel orifice 48 is accelerated to the point that there is only a partial mixing of the secondary fuel 40 with the primary air 24 and products of combustion 59 in a primary combustion zone 50 of the combustion tunnel 52. Therefore, the profile of combustion exiting the combustion tunnel 52 is more oxidizing toward the perimeter of combustion tunnel 52 and more reducing along the imaginary burner centerline C.

As best shown in FIG. 1, the secondary air 26 passes through the distribution tee 30 and into a secondary air conduit 54. The secondary air conduit 54 communicates the secondary air 26 to a secondary air jet 56 spaced apart from a combustion tunnel exit 62 of the combustion tunnel 52 and in fluid communication with a secondary combustion zone 60. Secondary air 26 exits the secondary air jet 56 at a velocity in the range of 150 feet/second to 400 feet/second (46–122 meters/second), depending on the air preheat, nominal design ratio of the burner 10, and rated input.

The burner 10 is capable of being operated with a single secondary air jet 56 or a plurality of secondary air jets 56. The secondary air jets 56 may be oriented parallel or convergent to the imaginary burner centerline C, shown as angle $\beta$ in FIG. 1. The secondary air 26 exits the secondary air jets 56 at a furnace wall 58 and creates a negative pressure region pulling the products of combustion 59 from the second combustion zone 60 back into the secondary air orifice 56, highly vitiating the secondary air 26 before the secondary air 26 reaches the sub-stoichiometric ratio mixture exiting the combustion tunnel 52. The resultant combustion expansion in the primary combustion zone 50 of combustion tunnel 52 also creates a suction at the furnace wall 58 in the vicinity of the combustion tunnel exit 62 which also induces the furnace products of combustion 59 back to the combustion tunnel exit 62.

The burner 10 configuration of the present invention provides vitiation in the primary and secondary combustion zones 50, 60 such that the stoichiometry to the burner 10 must be on the oxidizing side to initiate stable combustion in the secondary combustion zone 60 when below 1200° F. furnace temperature. At approximately 1200° F. (649° C.), the stoichiometry can be brought to approximately 10% excess air with the resulting main flame stability and the secondary combustion reactions completing without the generation of free combustibles. Minor traces of CO will be apparent with furnace temperature between 1200° F. and 1400° F. (649° C.–760° C.). The primary fuel 38 to secondary fuel 40 split ratio can be approximately 20/80 to 40/60, respectively, while the primary air 24 to secondary air 26 split ratio can be 40/60 to 70/30, respectively. The optimum primary fuel 38 to secondary fuel 40 split ratio is approximately 22/78, respectively, and the optimum primary air 24 to secondary air 26 split is approximately 50/50.

The air and fuel staged burner 10 according to this first embodiment significantly improves $NO_x$ emission capabilities, as illustrated in the following table:

TABLE 1

COMPARISION OF PRESENT INVENTION WITH AN AIR STAGED BURNER AT AN AIR TEMPERATURE OF 750° F. (399° C.) AND A FURNACE TEMPERATURE OF 1600° F. (871° C.)

| | AIR STAGED | FUEL & AIR STAGED |
|---|---|---|
| $NO_x$ PPM @ 3% | 44 | 22 |

The invention has been described with reference to the preferred embodiment. Obvious modifications and alterations will occur to others upon reading and understanding the preceding detailed description. It is intended that the invention be construed as including all such modifications and alterations.

We claim:

1. A method of decreasing NOx emissions in a burner (10) having a main burner body (22) that defines a combustion tunnel (52) and a source of secondary air (26) comprising the steps of:

a) flowing supply air (20) into the main burner body (22);

b) dividing the supply air (20) into primary air (24) and secondary air (26), wherein the ratio of primary air (24) to secondary air (26) is approximately in the range of 40/60 to 70/30, respectively;

c) flowing the primary air (24) into the combustion tunnel (52) at a given velocity;

d) flowing primary fuel (38) into the combustion tunnel (52) at a velocity lower than the velocity of the primary air (24);

e) flowing secondary fuel (40) into the combustion tunnel (52) at a velocity higher that the velocity of the primary fuel (38);

f) flowing the secondary air (26) into the secondary combustion zone (60) at a velocity higher than the velocity of the primary fuel (38);

g) igniting the primary fuel (38), the secondary fuel (40), and primary air (24) in the combustion tunnel (52) to form products of combustion (59);

h) exhausting the products of combustion (59) into a secondary combustion zone (60); and i) drawing the products of combustion (59) from the secondary combustion zone (60) to a combustion tunnel exit (62) and to the source of secondary air (26).

2. The method as claimed in claim 1 further comprising the step of:

j) vitiating the secondary air (26) before the secondary air (26) reaches a sub-stoichiometric ratio mixture exiting the combustion tunnel (52).

3. A method of decreasing $NO_x$ emissions in a burner (10) having a main burner body (22) defining a combustion tunnel (52) and a source of secondary air (26) comprising the steps of:

a) flowing supply air (20) into the main burner body (22);

b) dividing the supply air (20) into primary air (24) and secondary air (26);

c) flowing the primary air (24) into the combustion tunnel (52) at a given velocity;

d) flowing primary fuel (38) into the combustion tunnel (52) at a velocity lower than the velocity of the primary air (24);

e) flowing secondary fuel (40) into the combustion tunnel (52) at a velocity higher than the velocity of the primary fuel (38);

f) flowing the secondary air (26) into the secondary combustion zone (60) at a velocity higher than the velocity of the primary fuel (38); and g) igniting the primary fuel (38), the secondary fuel (40), and primary air (24) in the combustion tunnel (52) to form products of combustion (59);

h) exhausting products of combustion (59) into a secondary combustion zone (60); and i) drawing products of combustion (59) from the secondary combustion zone (6) to a combustion tunnel exit (62) and to the source of secondary air (26).

4. The method as claimed in claim 3, wherein the primary air (24) flows into the combustion tunnel (52) at a rate of approximately 300–400 feet per second at rated input.

5. The method as claimed in claim 3, wherein the secondary air (26) flows in the secondary combustion zone (60) at a velocity of approximately 150–400 feet/second at rated input.

6. The method as claimed in claim 3, wherein the primary fuel (38) to secondary fuel (40) split ratio is in the range of approximately 20/80 to 40/60, respectively.

7. The method as claimed in claim 3, wherein the primary fuel (38) flows into the combustion tunnel (52) at a velocity less than approximately 100 feet/second at rated input.

8. The method as claimed in claim 3, wherein the secondary fuel (40) flows into the combustion tunnel (52) at a velocity approximately greater than 350 feet/second at rated input.

9. The method as claimed in claim 3 further comprising the step of:

j) vitiating the secondary air (26) before the secondary air (26) reaches a sub-stoichiometric ratio mixture exiting the combustion tunnel (52).

* * * * *